US005931350A

United States Patent [19]

Heilman

[11] Patent Number: 5,931,350

[45] Date of Patent: Aug. 3, 1999

[54] PUSH PULL DISPENSING CLOSURE

[75] Inventor: Robert J. Heilman, Orland Park, Ill.

[73] Assignee: Crown Cork & Seal Technologies Corporation, Alsip, Ill.

[21] Appl. No.: 08/800,860

[22] Filed: Feb. 13, 1997

[51] Int. Cl.[6] ..... B65D 5/72

[52] U.S. Cl. ..... 222/153.14; 222/499; 222/525

[58] Field of Search ..... 222/499, 525, 222/559, 562, 153.06, 153.14

[56] References Cited

U.S. PATENT DOCUMENTS

| | | | |
|---|---|---|---|
| 3,232,499 | 2/1966 | Esposito | 222/499 |
| 3,321,114 | 5/1967 | Croyle | 222/499 |
| 5,465,876 | 11/1995 | Crisci | 222/525 X |

*Primary Examiner*—Gregory L. Huson
*Attorney, Agent, or Firm*—Woodcock Washburn Kurtz Mackiewicz & Norris LLP

[57] ABSTRACT

A dispensing closure for installation on a bottle finish having a mouth comprises a cap which covers the mouth, and an upwardly bowed diaphragm between the cap and the mouth, normally in contact with the cap. The mouth has a concave frustoconical end surface, and the cap has a circular rib overlying the end surface so that when the cap is pressed downward, it depresses the diaphragm, opening a flow path through an aperture in the cap. In one embodiment of this invention, a sealing interface is formed between the diaphragm and the bottom of the cap, around the aperture, while in another embodiment, a seal is formed around a central aperture in the diaphragm by a protrusion on the bottom surface of the cap.

18 Claims, 1 Drawing Sheet

PUSH PULL DISPENSING CLOSURE

BACKGROUND OF THE INVENTION

This invention relates to the art of closures for containers, particularly to push-pull dispensing closures.

Prior inventors have designed a great number of closures which act as valves, to retain a container's contents from manufacture through the point of sale. To guard against poisoning, tampering and/or spillage, many such closures are provided with a tear strip or frangible area which must be deliberately destroyed or removed before the product can be used. Some prior closures have caps or operators which are moved lengthwise of the bottle, between open and closed positions. A closure having such features is the subject of this invention.

SUMMARY OF THE INVENTION

An object of the invention is to simplify the manufacture of a push-pull bottle closure.

Another object of the invention is to provide a valving closure with a flush discharge surface which tends not to accumulate the dispensed product.

A further object of the invention is to render a push-pull closure safe by providing it with a tear strip or frangible area which must be destroyed or removed before use.

These and other objects are attained by a push-pull dispensing closure for installation over a bottle mouth. The closure comprises a cap which covers the mouth, and an upwardly bowed diaphragm between the cap and the mouth, normally in contact with the cap. The mouth has an end surface which acts as a fulcrum, and the bottom surface of the cap has a projection such as a circular rib radially inboard of the fulcrum, so that when the cap is pressed downward, the projection flexes the diaphragm, opening a flow path through an aperture in the cap.

In one embodiment of this invention, a sealing interface is formed between the diaphragm and the bottom of the cap, around the aperture, while in another embodiment, a seal is formed around a central aperture in the diaphragm by a protrusion on the bottom surface of the cap.

BRIEF DESCRIPTION OF THE DRAWINGS

In the accompanying drawings.

DESCRIPTION OF THE PREFERRED EMBODIMENT

Figure 1:
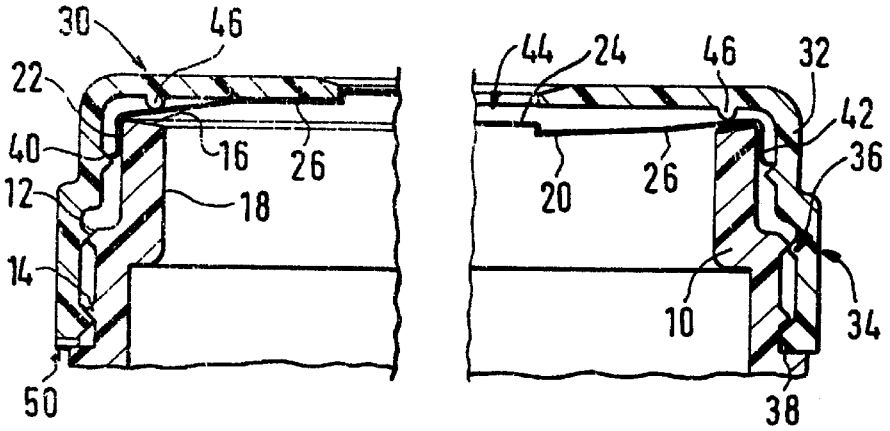
FIG. 1 is a section of a push-pull dispensing closure embodying the invention, taken in a plane containing the longitudinal axis of the closure.

A push-pull dispensing closure embodying the invention is shown in FIG. 1. It is shown installed on a bottle whose finish 10 has a pair of circumferential beads 12,14 and a reduced diameter upper end 16 defining a mouth 18. The end surface of the mouth is tapered downward slightly, thus defining a concave frustoconical surface.

The mouth is covered by a flexible diaphragm 20 having a peripheral flange 22 that tightly surrounds the upper end of the finish to prevent leakage around it. The diaphragm has a raised central portion 24, surrounded by one or more—preferably several—large holes 26.

The diaphragm can be moved from the position shown to the left of FIG. 1, to that shown to the right, by depressing a cap 30 which has a peripheral flange 32 terminating at an enlarged skirt 34. The skirt has internal protrusions 36 which engage the bead 12, and a lowermost internal rib 38 to retain the cap on the bottle finish, below the bead 14. The flange 32 has a second internal circumferential ridge 40 near the flange 42 of the diaphragm. The diaphragm is preferably made of a metal such as stainless steel or aluminum or tin plate, but could conceivably be made of stiff plastic or another material. The material chosen must be sufficiently stiff so that the mouth, rib and center of the diaphragm act as a lever, yet sufficiently resilient to permit some deformation of the diaphragm, without requiring excessive pressure on the cap.

The cap has a central aperture 44 as large as the raised portion of the diaphragm, and the diaphragm is manufactured with a slightly domed shape so that the raised portion normally seats in the aperture, as shown in the left half of the figure. A circular ridge 46 on the bottom of the cap overlies the inner edge of the mouth; the rib engages the diaphragm when the cap is displaced downward slightly, forcing the diaphragm away from the cap and opening the aperture, as shown in the right half of the figure. The geometry of the arrangement, with the ridge very close to the fulcrum point, results in great movement of the center portion of the diaphragm for relatively small movement of the cap periphery. Thus, it may be seen that only a very small displacement is needed to open fully the valve created at the sealing interface between the diaphragm and the cap. When the valve is open, the contents of the container may pass through the holes in the diaphragm, and out through the central aperture in the cap. The bead 12 and the protrusions 36 are arranged so that the protrusions act as detents, somewhat resisting cap displacement initially, then locking the cap down, so that the valve remains open until the detents are disengaged by squeezing the skirt at locations 90° from the protrusions. Suitable markings (not shown) may be provided on the skirt to identify such locations. When the cap is released, the diaphragm, acting as a return spring, restores the cap to its original (closed) position.

Figure 2:
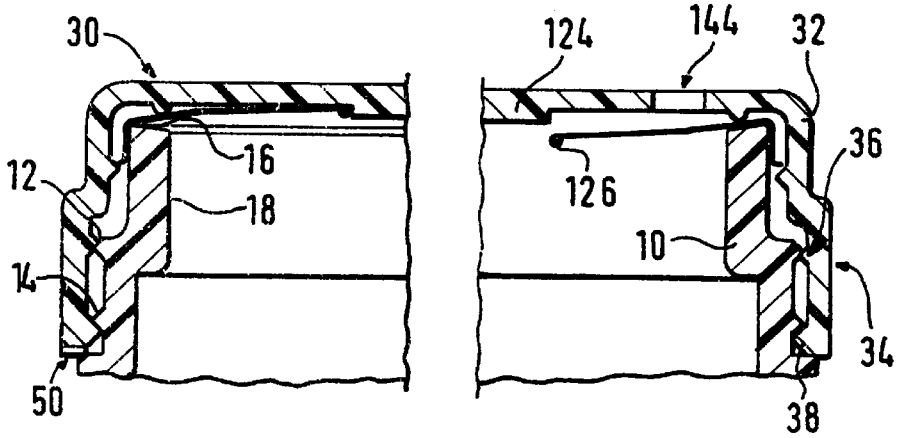
FIG. 2 is a similar view of a second embodiment of the invention.

In the embodiment of FIG. 2, the aperture 144 in the cap is located radially outward from the center of the cap, and the cap has a round protrusion 124 on its bottom surface, which protrusion seats within a single hole 126 in the middle of the diaphragm. The parts are otherwise identical, and the diaphragm still allows material to exit the container via the hole and aperture in series, only when the cap is depressed. In the embodiment of FIG. 1, the cap is manufactured with a removable tear strip 50 which, until removed, locks the cap in its uppermost position, which is defined by interference between the lower bead 14 and the internal rib 38 on the cap.

Figure 3:
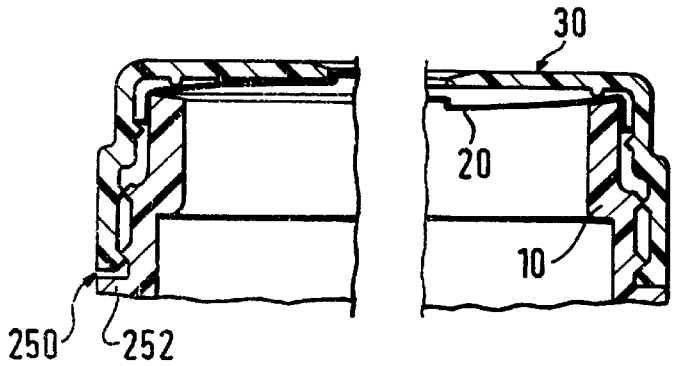
FIG. 3 is a similar view of a third embodiment of the invention.

The embodiment represented in FIG. 3 is like that of FIG. 1, except the cap is initially held in the upward position by s series of bridges 250 defined between scores or slots in material interconnecting the bottom of the skirt 34 and the shoulder 252 on the bottle below the finish. The bridges must be broken by manipulating the cap, for example by twisting it, before the cap may be depressed to open the valve.

Figure 4:
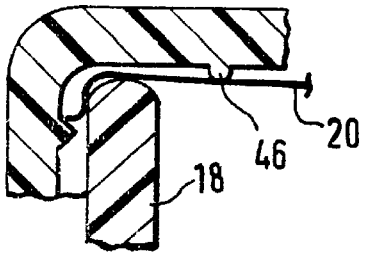
FIG. 4 shows a slightly modified form of the cap illustrated in FIG. 1.

While it is presently preferred that the end of the bottle finish be concave, so that the outer edge acts as a fulcrum when the cap is depressed, it should be understood that other constructions are possible, which will produce the required levering action. For example, the projecting rib could be moved radially inward (see FIG. 4) so that it does not overlie the mouth. In this case, the end of the finish could be square (flat, not frustoconical), and the fulcrum point would then be the inner edge of the end surface.

Also, while a continuous circular rib is the preferred form of the means for applying force to the diaphragm, it is recognized and suggested that other designs—such as a series of bumps or bosses on the bottom of the cap—would be functionally equivalent. Or, the cap might have a smooth non-planar shape designed to contact the diaphragm at points inboard of the fulcrum.

Since the invention is subject to other modifications and variations, it is intended that the foregoing description and the accompanying drawings shall be interpreted as only illustrative of the invention defined by the following claims.

I claim:

1. A push-pull dispensing closure for installation on a bottle finish having a mouth with an end surface, said closure comprising a cap which covers the mouth and has an aperture for dispensing a fluent material, and a diaphragm disc between the cap and the mouth, normally in contact with the cap and having a center portion blocking the aperture, said disc having at least one hole arranged in non-overlapping fashion with respect to the aperture in the cap said cap being axially movable on the finish, and having at least one projecting structure inboard of a fulcrum point on said end surface so that when the cap is depressed a given distance, it moves a center portion of the diaphragm a greater distance, unblocking the aperture.

2. The intention of claim 1, wherein the aperture is centered in the cap and the diaphragm has an upward protrusion at its center which normally seats within the aperture to seal the container, but which unseats when the center portion of the diaphragm is moved by depressing the cap.

3. The invention of claim 1, wherein the cap has a central aperture and the center portion of the diaphragm has a protrusion which normally seats within the hole to seal the container but which unseats when the center portion of the diaphragm is moved by depressing the cap.

4. The invention of claim 1, wherein the diaphragm is made of a metal.

5. The invention of claim 1, wherein the end surface of the bottle finish is bevelled inward, so that fulcrum is the outer edge of the end surface.

6. The invention of claim 1, wherein the projecting structure is a circular rib on the bottom surface of the cap.

7. The invention of claim 1, wherein the projecting structure comprises a plurality of bumps or bosses on the bottom surface of the cap.

8. The invention of claim 1, further comprising a removable tear strip molded between a skirt on the cap and the bottle, so that the cap cannot be depressed until the tear strip has been removed.

9. The invention of claim 1, further comprising a tamper evident structure molded between a skirt on the cap and the bottle, so that the cap cannot be depressed until the tamper evident structure has been removed by manipulating the cap.

10. The invention of claim 1, wherein the cap has a flexible skirt surrounding the bottle finish, said skirt having a pair of opposed protrusions which engage below a bead on the finish to hold the cap open once it is depressed until the protrusions are released by squeezing the skirt.

11. The invention of claim 10, further comprising means on the skirt for retaining the cap on the finish.

12. The invention of claim 11, wherein the retaining means comprises an internal rib on the skirt, below the protrusions, said rib engaging below a second bead on the bottle finish.

13. A push-pull dispensing closure for installation on a bottle finish having a mouth with an end surface, said closure comprising a cap which covers the mouth and has at least one aperture for dispensing a fluent material, a diaphragm disc between the cap and the mouth, normally in contact with the cap, said disc having at least one hole, said cap being axially movable on the finish and having sealing means normally sealing said hole and having at least one aperture arranged in a non-overlapping fashion with respect to the hole in said disc so that, when the cap is depressed, the sealing means clears the hole, allowing said material to flow through the hole and out the apertures in the cap, and a tamper-evident structure adapted to provide a visible indication once the closure has been opened.

14. The invention of claim 13, wherein the tamper-evident structure comprises a removable tear strip molded between a skirt on the cap and the bottle, so that the cap cannot be depressed until the tear strip has been removed.

15. The invention of claim 13, wherein the tamper-evident structure is molded between a skirt on the cap and the bottle, so that the cap cannot be depressed until the tamper evident structure has been removed by manipulating the cap.

16. The invention of claim 13, wherein the cap has a flexible skirt surrounding the bottle finish, said skirt having a pair of opposed protrusions which engage below a bead on the finish, to hold the cap open once it is depressed until the protrusions are released by squeezing the skirt.

17. The intention of claim 16, further comprising means on the skirt for retaining the cap on the finish.

18. The invention of claim 17, wherein the retaining means comprises an internal rib on the skirt, below the protrusions, said rib engaging below a second bead on the bottle finish.

* * * * *

UNITED STATES PATENT AND TRADEMARK OFFICE

CERTIFICATE OF CORRECTION

PATENT NO. : 5,931,350
DATED : August 3, 1999
INVENTOR(S) : Heilman

It is certified that error appears in the above-identified patent and that said Letters Patent is hereby corrected as shown below:

Column 2,
Line 59, please delete "s series" and insert therefor -- a series --;

Column 3,
Line 1, please delete "intention" and insert therefor -- invention --.

Signed and Sealed this

Twenty-third Day of July, 2002

*Attest:*

*Attesting Officer*

JAMES E. ROGAN
*Director of the United States Patent and Trademark Office*